United States Patent [19]

Watanabe et al.

[11] Patent Number: 4,711,020

[45] Date of Patent: Dec. 8, 1987

[54] TOP END-STOP ATTACHING MACHINE WITH IMPROVED TOP END-STOP SUPPLYING APPARATUS

[75] Inventors: Kozo Watanabe, Kurobe; Akiyoshi Kando, Uozu; Yoshiyuki Horita, Toyama, all of Japan

[73] Assignee: Yoshida Kogyo K.K., Tokyo, Japan

[21] Appl. No.: 901,658

[22] Filed: Aug. 29, 1986

[30] Foreign Application Priority Data

Sep. 5, 1985 [JP] Japan ..... 60-196628
Sep. 13, 1985 [JP] Japan ..... 60-140105[U]

[51] Int. Cl.[4] ..... A41H 37/06

[52] U.S. Cl. ..... 29/767; 29/33.2; 198/388; 198/468.1; 221/201

[58] Field of Search ..... 29/33.2, 408, 766, 767; 198/388, 468.1; 221/178, 201

[56] References Cited

U.S. PATENT DOCUMENTS 2,523,388 9/1950 Natzke et al. ..... 29/408
4,137,621 2/1979 Scagnelli ..... 29/33.2
4,307,511 12/1981 Yoshida ..... 29/767
4,332,071 6/1982 Takahashi ..... 29/767
4,561,161 12/1985 Morita ..... 29/767

FOREIGN PATENT DOCUMENTS 2017811 10/1979 United Kingdom ..... 29/408

*Primary Examiner*—P. W. Echols
*Attorney, Agent, or Firm*—Hill, Van Santen, Steadman & Simpson

[57] ABSTRACT

An apparatus for supplying U-shaped top end stops reliably one at a time to a holding portion of a top end-stop attaching machine, includes a movable guide rail reciprocably movable between a receiving position for receiving the top end stop from a fixed guide rail cantilevered to a vibrating parts feeder, and a delivery position for supplying the top end stop therefrom to the holding portion, and a delivery unit reciprocably movable toward and away from the holding portion to deliver a leading top end stop from the first guide rail through the second guide rail to the holding portion. The movable guide rail and the delivery unit are linked such that the delivery unit resiliently engages with the movable guide rail within a certain range of its reciprocating stroke for moving the movable guide rail from the receiving position to the delivery position.

14 Claims, 21 Drawing Figures

TOP END-STOP ATTACHING MACHINE WITH IMPROVED TOP END-STOP SUPPLYING APPARATUS

This case is related to U.S. application Ser. No. 897,815, filed Aug. 19, 1986.

BACKGROUND OF THE INVENTION

1. Field of the Invention

The present invention relates to an apparatus for supplying top end stops to a holding portion of a top end-stop attaching machine for applying the top end stops to a continuous slide fastener chain.

2. Prior Art

One known top end-stop supplying apparatus is disclosed in Japanese Patent Publication No. 48-42582 and reillustrated here in FIG. 9 of the accompanying drawings. The known apparatus includes an inclined gravity chute 15 for slidably receiving a multiplicity of generally U-shaped top end stops 16, and a reciprocable pusher arm 17 disposed at the lower end of the chute 15 for supplying the top end stops 16 one at a time to the holding portion 18 of a top end-stop holder 19 in a top end-stop attaching machine.

With the apparatus thus constructed, the top end stops 16 are likely to lie one upon another as they intermittently slide downwardly along the chute 15 in response to the reciprocating movement of the pusher arm 17. The top end stops thus overlapped tend to jam the chute 15 with the result that a reliable top end-stop supplying operation is difficult to achieve.

SUMMARY OF THE INVENTION

It is accordingly an object of the present invention to provide an apparatus for supplying top end stops reliably one at a time to a holding portion of a top end-stop attaching machine for attaching the top end stops to a continuous slide fastener chain.

According to the present invention, a top end-stop supplying apparatus includes a movable guide rail reciprocably movable between a receiving position for receiving the top end stop from a fixed guide rail cantilevered to a vibrating parts feeder, and a delivery position to supply the top end stop therefrom to a holding portion of a top end-stop attaching machine, and a delivery unit reciprocably movable toward and away from the holding portion to deliver a leading top end stop from the first guide rail through the second guide rail to the holding portion. The movable guide rail and the delivery unit are linked such that the delivery unit resiliently engages with the movable guide rail within a certain range of its reciprocating stroke for moving the movable guide rail from the receiving position to the delivery position. The delivery unit may include a vertical stabilizing plate continuously engageable with the leading top end stop as the latter is moved along the upper longitudinal edges of the first and second guide rails, for preventing the leading top end stop from displacing upwardly away from the upper longitudinal edges of the first and second guide rails.

Many other advantages, features and objects of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
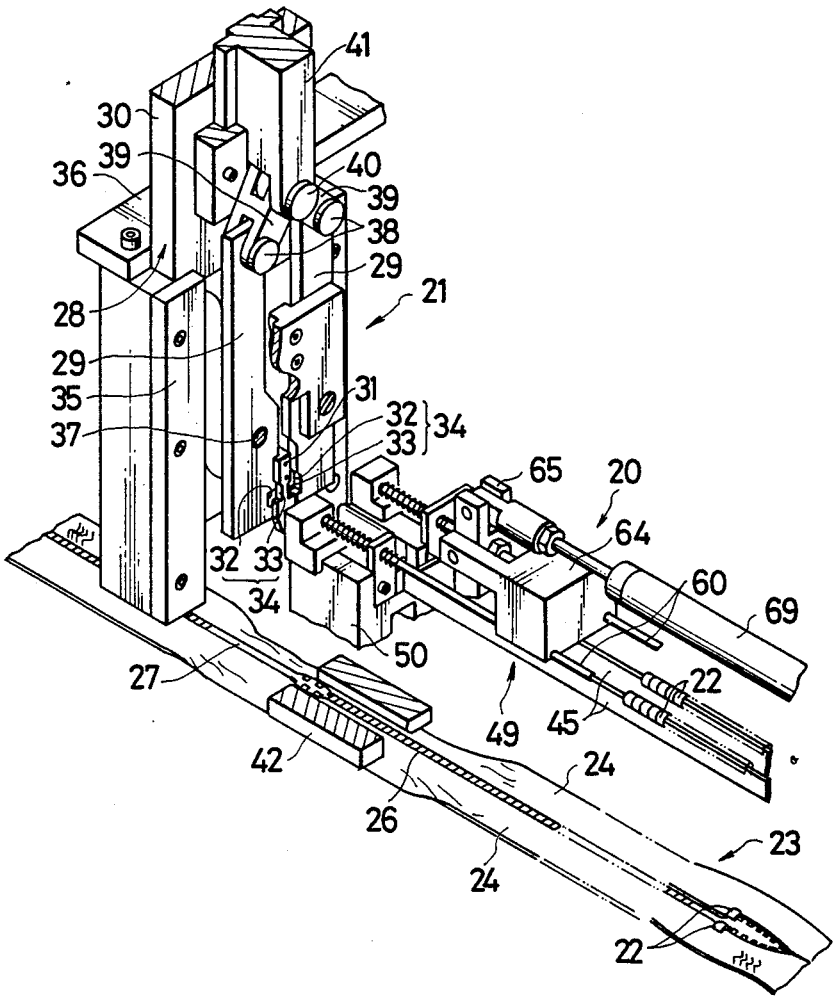
FIG. 1 is a fragmentary perspective view of a top end-stop attaching machine including an apparatus for supplying top end stops to the machine according to the present invention.

The principles of the present invention are particularly useful when embodied in a top end-stop supplying apparatus, such as shown in FIG. 1, generally indicated by the reference numeral 20. The apparatus 20 is associated with a top end-stop attaching machine 21 for supplying top end stops 22 of a substantially U-shape to a holding portion of the machine 21 for attaching the top end stops 22 to a continuous slide fastener chain 23.

Figure 2:
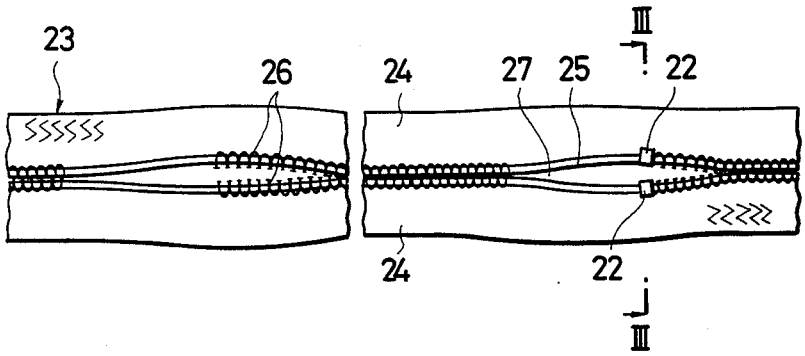
FIG. 2 is a fragmentary plan view of a continuous slide fastener chain to which top end stops are to be applied.
Figure 3:
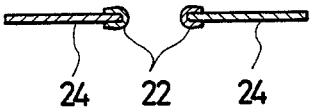
FIG. 3 is a cross-sectional view taken along line III—III of FIG. 2, showing attached top end stops.

The slide fastener chain 23 comprises a pair of slide fastener stringer tapes 24 each having a beaded longitudinal marginal edge 25 (FIG. 2) supporting thereon successive rows of coupling elements 26. The slide fastener chain 23 also has a plurality of longitudinally spaced element-free spaces or gaps 27 between the successive rows of coupling elements 26. The top end stops 22 are attached to the beaded marginal edges 25 in the element-free spaces 27 adjacent to ends of each row of coupling elements 26.

The top end-stop attaching machine 21 includes a clamping mechanism 28 which generally comprises a pair of vertical punch arms 29, 29 angularly movably mounted on a vertical punch/die holder 30, and a die 31 fixedly mounted on the punch/die holder 30 and positioned between the lower ends of the punch arms 29, 29. The inner lower surfaces of the punch arms 29, 29 have recesses 32, 32, respectively, defined therein, whereas the opposite outer surfaces of the die 31 have recesses 33, 33, respectively, defined therein and positioned in confronting relation to the recesses 32, 32. These recesses 32, 33 jointly define therebetween a pair of holding portions or cavities 34, 34 for retaining the substantially U-shaped top end stops 22.

The punch/die holder 30 is vertically movable in a channel-shaped holder guide 35 by a suitable actuator (not shown) between an upper position to receive top end stops and a lower position to attach top end stops. The channel-shaped holder guide 35 is fastened to a frame 36 of the machine 21. The punch arms 29, 29 are angularly movably supported by respective pivot pins 37, 37 on the punch/die holder 30, the pivot pins 37 being positioned below the intermediate portions of the punch arms 29, 29, i.e. more closely to the lower ends of the punch arms 29, 29 than to the upper ends thereof. The upper ends of the punch arms 29, 29 are operatively connectd by first pivot pins 38, 38 to a pair of links 39, 39, respectively, operatively coupled by a second pivot pin 40 to the lower end of a ram 41. The ram 41 is operatively connected to a suitable actuator, such as a pneumatic cylinder (not shown). When the actuator is operated, the ram 41 reciprocates vertically to angularly move the punch arms 40, 40 toward and away from each other about the pivot pins 37.

The top end-stop attaching machine 21 further includes a chain guide 42 disposed below the clamping mechanism 28 for guiding the fastener chain 23 to position one of the element-free spaces 27 with respect to the clamping mechanism 28 in such a manner that the beaded marginal edges 25 defining the element-free space 27 are directed upwardly for easy application of the U-shaped top end stops 22 to such erected marginal edges 25 adjacent to one of the ends of the rows of coupling elements 26.

Figure 4:
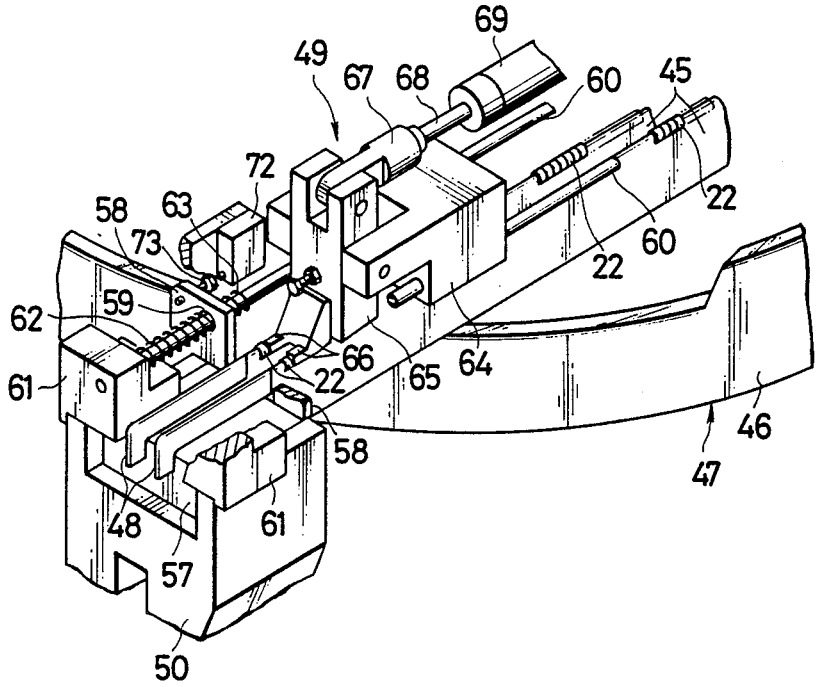
FIG. 4 is an enlarged fragmentary perspective view of the top end-stop supplying apparatus.

As shown in FIGS. 1 and 4, the top end-stop supplying apparatus 20 generally comprises a pair of fixed guide rails 45 extending horizontally from a bowl 46 of a vibrating parts feeder 47 (FIG. 4) toward the holding portions 34, 34 of the clamping mechanism 28, a pair of movable guide rails 48 (FIG. 4) disposed respectively between the fixed guide rails 45 and the clamping mechanism 28 and reciprocably movable between downstream ends of the respective fixed guide rails 45 and the holding portions 34, and a reciprocable delivery unit 49 disposed above the fixed guide rails 45 and reciprocably movable along the fixed and movable guide rails 45, 48 for supplying two top end stops 22 at a time from the fixed guide rails 45 through the movable guide rails 48 to the holding portions 34.

The fixed horizontal guide rails 45 are composed of a pair of parallel spaced elongate plates connected at their one ends to the vibrating parts feeder 47, these ends communicating with an outlet of the bowl 46. The plates or guide rails 45 have opposite ends or downstream ends disposed short of an upstanding support block 50 disposed in front of the clamping mechanism 28. With this construction, the vibrating parts feeder 47 generates a vibratory motion to cause the U-shaped top end stops 22 to depart from the bowl 46 onto the guide rails 45 with their legs astride the upper longitudinal edges of the respective guide rails 45, and then to advance progressively toward the downstream ends of the guide rails 45 along the upper longitudinal edges. The cantilevered guide rails 45 oscillate in synchronism with the oscillation of the vibrating parts feeder 47 with the result that the top end stops 22 are advanced in ordinal rows without overlapping one another.

Figure 5:
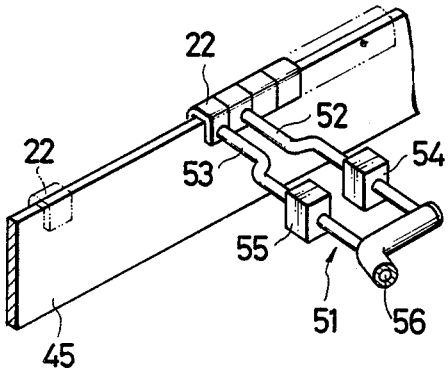
FIG. 5 is a fragmentary perspective view of a gate means associated with a chute of the apparatus for delivering top end stops one at a time.

The advancing movement of the top end stops 22 is temporarily arrested by a gate means 51 disposed slightly upstream of the downstream end of each guide rail 45, as shown in FIG. 5. The gate means 51 includes a pair of first and second suction pipes 52, 53 disposed on one side of the guide rail 45 and opening perpendicularly toward the upper longitudinal edges of the guide rail 45 along which the top end stops 22 are advanced. The first and second suction pipes 52, 53 are laterally spaced from one another by a distance slightly larger than the extent of each top end stop 22 along the longitudinal direction of the guide rail 45. The suction pipes 52, 53 are connected respectively through a pair of first and second directional control valves 54, 55 to a main pipe 56 which is connected with a suitable vacuum source (not shown). With this construction, one top end stop 22 is held immovable on the guide rail 45 by a suction force acting between the upper longitudinal edge of the guide rail 45 and each suction pipe 52, 53. The first and second valves 54, 55 are operated to alternately block the first and second suction pipes 52, 53, thereby allowing passage of the top end stops 22 one at a time through the gate means 51 by the vibration of the guide rail 45. The leading top end stop 22 departing from the gate means 51 is automatically stopped at a position immediately upstream of the downstream end of the guide rail 45. To this end, the downstream end portion of the guide rail 45 is so constructed as to substantially reduce the magnitude of the vibrating motion transmitted from the vibrating parts feeder 47. Although not shown, the pneumatic gate means 51 may be replaced by a mechanical gate having a pair of blocking fingers alternately movable across the upper longitudinal edge of the guide rail 45. As a further alternative, it is possible to control the vibration of the guide rail 45.

As shown in FIG. 4, the movable guide rails 48 are composed of a pair of parallel spaced elongate plates extending in alignment with the fixed guide rails 45. The guide rails or plates 48 are mounted on an upper surface of a rectangular slide block 57 slidably received in an upper recessed portion of the support block 50. The slide block 57 is slidably movable in a direction parallel to the guide rails 48 so that the guide rails 48 are reciprocably movable between a receiving position in which upstream ends of the respective guide rails 48 are held in abutment with the downstream ends of the fixed guide rails 45, and a delivery position in which downstream ends of the respective guide rails 48 are held in registry with the corresponding holding portions 34 of the clamping mechanism 28.

A pair of vertical support plates 58, 58 is secured to an end wall of the slide block 57 facing toward the parts feeder 47, the support plates 58 being disposed adjacent to opposite sidewalls of the slide block 57. The guide plates 58 include a pair of guide holes 59 (only one being shown), respectively, through which a pair of guide rods 60 extend. The guide rods 60 have their one ends connected to a pair of brackets 61, 61 secured to the upper portion of the support block 50 in confronting relation to the support plates 58, 58. The brackets 61 are disposed adjacent to an end of the support block 50 disposed closely to the clamping mechanism 28. The brackets 61 partly overlie the slide block 57 to prevent upward displacement of the latter. The guide rods 60 extend parallel to the movable and fixed guide rails 48, 45 and are secured at their opposite ends to a frame (not shown) of the apparatus 20. Each of the guide rods 60 supports thereon a first compression coil spring 62 disposed between and acting between one of the brackets 61 and the corresponding support plate 58. With this construction, the slide block 57 is normally urged by the first compression coil springs 62 toward the parts feeder 47 for thereby holding the movable guide rails 48 in the receiving position. A pair of second compression coil springs 63 of a predetermined length is disposed around the respective guide rods 60 in opposite relation to the first compression coil springs 62 with respect to the support plates 58.

The delivery unit 49 generally comprises, as shown in FIG. 4, a generally L-shaped arm holder 64 slidably mounted on the guide rods 60, and a generally L-shaped delivery arm 65 pivotably connected to the arm holder 64 and having a pair of bifurcated delivery fingers 66 projecting from a lower end of the arm 65 toward the movable guide rails 48. Each of the delivery fingers 66 includes a recessed bottom wall **66*a* (only shown in FIG. 6A) respectively slidably engageable with the upper longitudinal edges of the fixed and movable guide rails 45, 48. The upper end of the delivery arm 65 is pivotably connected to a link 67 secured to a piston rod 68 of a pneumatic cylinder 69 horizontally supported by the frame of the apparatus 20, the cylinder 69 extending parallel to the guide rails 45**.

Figure 6A:
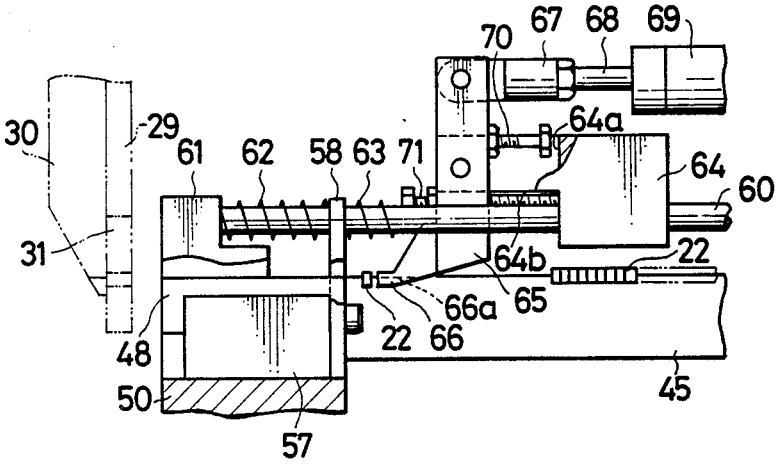
FIGS. 6A through 6F are schematic side elevational views showing the manner in which top end stops are supplied two at a time to holding portions of the attaching machine by the supplying apparatus.
Figure 6B:
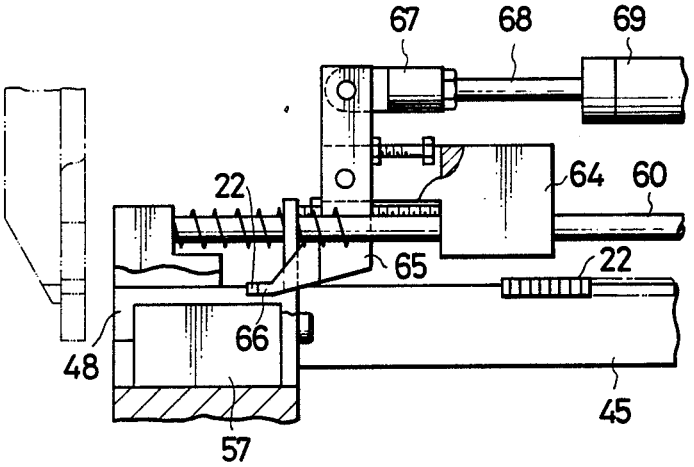
Figure 6C:
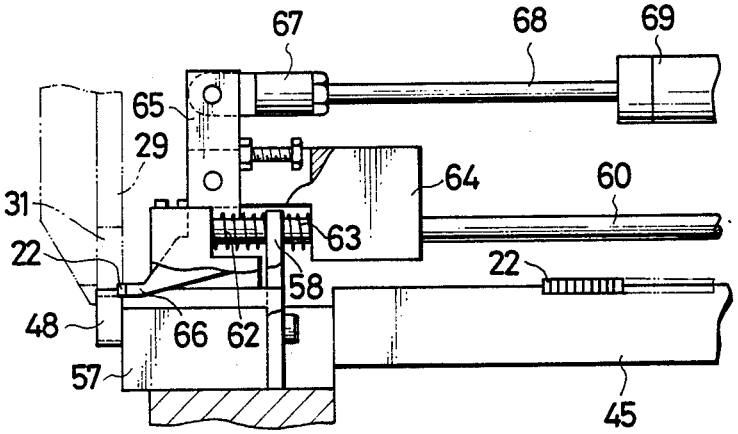
Figure 6D:
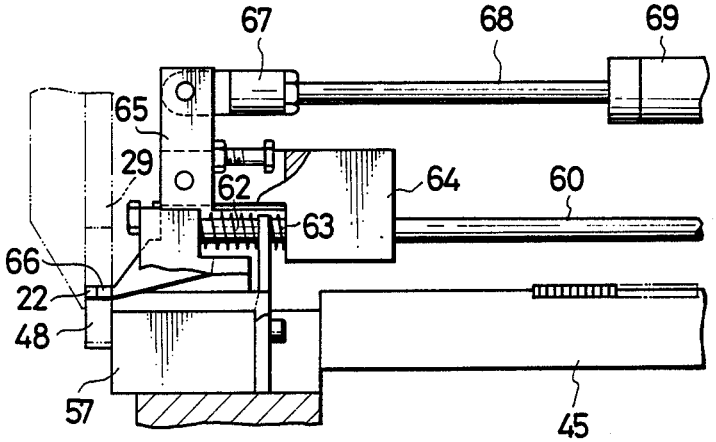
Figure 6E:
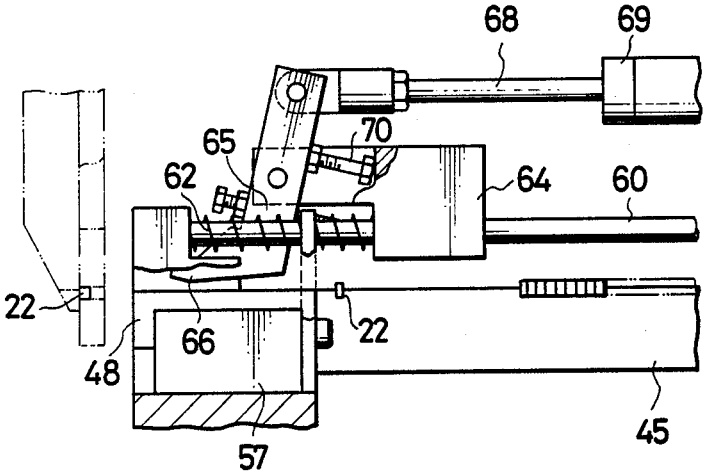
Figure 6F:
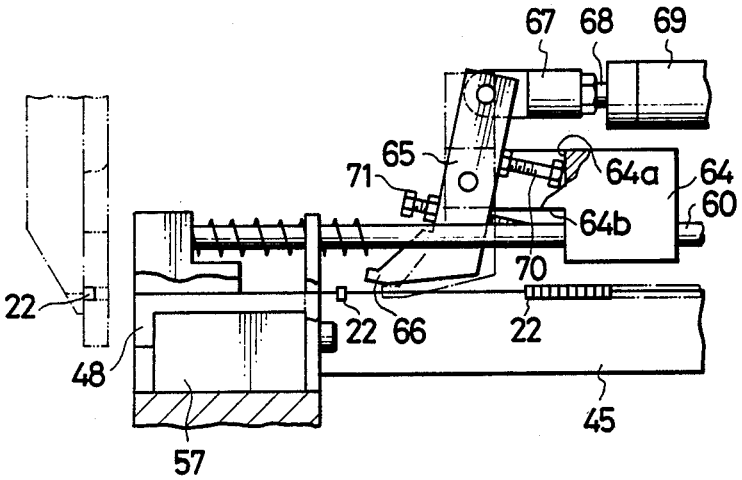

As shown in FIGS. 6A and 6F, a pair of upper and lower stopper bolts 70, 71 is disposed one on each side of the pivot of the delivery arm 65 to limit angular movement of the delivery arm 65 to a certain angular range. The upper stopper bolt 70 projects perpendicularly from the arm 65 toward a vertical end wall **64*a* of the arm holder 64 and terminates short of the vertical end wall 64*a*. When the arm 65 is turned clockwise in the same figures, the stopper bolt 70 is brought into abutment with the vertical end wall 64*a*, as shown in FIG. 6F, thereby preventing further angular movement of the arm 65. On the other hand, the lower stopper bolt 71 extends transversely across the arm 65 to project toward the vertical end wall 64*a* in underlying relation to a horizontal bottom wall 64*b* of the arm holder 64. The lower stopper bolt 71 is engageable with the horizontal bottom wall 64*b* to limit angular movement of the arm 65 in the counter-clockwise direction. The upper and lower stopper bolts 70, 71 are axially movable to adjust the range of angular movement of the arm 65 so as to ensure that the delivery fingers 66 are angularly movable between a horizontal working position of FIG. 6A in which the recessed bottom walls 66*a* of the fingers 66 are held in light contact with the upper longitudinal edges of the guide rails 45, and an upwardly tilted non-working position of FIG. 6F in which the fingers 66 are spaced upwardly away from the upper longitudinal edges of the guide rails 45 for allowing passage of the top end stops 22 between the fingers 66** and the upper longitudinal edges.

As shown in FIG. 4, a microswitch 72 is disposed adjacent to the downstream end of one fixed guide rail 45. The microswitch 72 is operatively connected with the non-illustrated actuator for the clamping mechanism 28 for controlling the operation of the clamping mechanism 28. One of the support plates 58 supports thereon an actuating bolt 73 engageable with an actuator of the microswitch 72 to activate the microswitch 72. The microswitch 72 and the actuating bolt 73 are positioned such that the actuating bolt 73 is engageable with the microswitch 72 to activate the latter only when the movable guide rails 48 approach their receiving positions. Upon activation of the microswitch 72, the clamping mechanism 28 is lowered toward the slide fastener chain 23 for attaching the top end stops 22 to the beaded marginal edges 25 of the stringer tapes 24. While the actuating bolt 73 is spaced from the microswitch 72, the downward movement of the clamping mechanism 28 cannot take place.

The microswitch 72 may be connected with the vibrating parts feeder 47 to interrupt operation of the parts feeder to prevent the top end stops from accidentally falling from the downstream ends of the respective fixed guide rails 45 while the movable guide rails 48 are separated from the fixed guide rails 45.

Operation of the top end-stop supplying apparatus 20 is described below in detail with reference to FIGS. 6A–6F.

For purposes of illustration, operation of the apparatus 20 begins with parts in the condition shown in FIG. 6A. In this condition, the piston rod 68 of the cylinder 69 is slightly extended to locate the delivery fingers 66 immediately upstream of a pair of leading top end stops 22 which have been advanced to the downstream end portions of the guide rails 45 along the upper longitudinal edges of the respective guide rails 45. The movable guide rails 48 are held in the receiving positions and hence they are contiguous to the corresponding fixed guide rails 45. The punch/die holder 30 (indicated by phantom lines) is held in the uppermost position to receive the top end stops 22.

As the piston rod 68 is further extended to the position of FIG. 6B, the arm holder 64 is forced by the cylinder 69 to slide forwardly toward the punch/die holder 30 along the guide rods 60. The forward movement of the arm holder 64 causes the delivery fingers 66 to slide successively along the upper longitudinal edges of the fixed guide rails 45 and along the upper longitudinal edges of the movable guide rails 48, thereby moving the leading top end stops 22 from the fixed guide rails 45 to the movable guide rails 48. During that time, the movable guide rails 48 are kept immovable by the force of the first compression coil springs 62.

Figure 7:
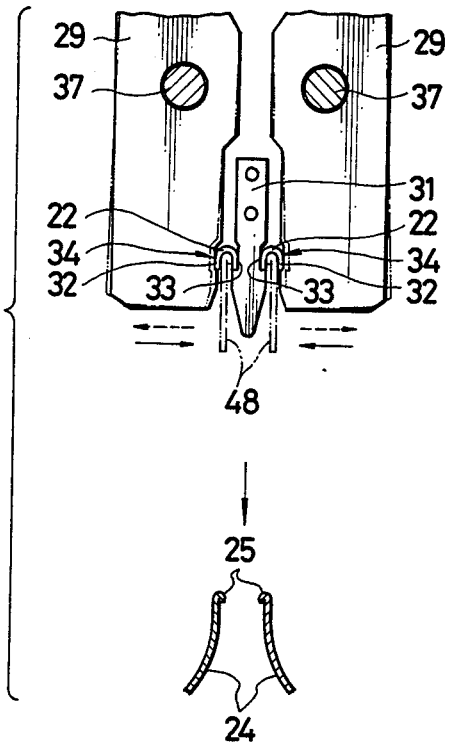
FIG. 7 is an enlarged fragmentary front elevational view of the holding portions in which top end stops supplied by the apparatus are retained.

A further forward movement of the piston rod 68 causes the delivery fingers 66 to advance the leading top end stops 22 to the downstream end portions of the respective movable guide rails 48. During that time, the arm holder 64 is brought into engagement with the second compression coil springs 63 and then urges the support plates 58 forwardly against a combined force of the first and second compression coil springs 62, 63 whereupon the slide block 57 slides forwardly to bring the movable guide rails 48 to their delivery positions, as shown in FIG. 6C. In this delivery position, the downstream ends of the respective movable guide rails 48 are held in registry with the holding portions 34 (FIG. 7) between the punch arms 29 and the die 31. The second compression coil springs 63 have a length short enough to ensure that the arm holder 64 is brought into compressing engagement with these second springs 63 only after the leading top end stops 22 have been transferred from the fixed guide rails 45 to the movable guide rails 48. Because the second compression coil springs 63 are disposed in series with the first compression coil springs 62, a relatively large forward stroke of the movable guide rails 48 is available with the result that the downstream ends of the respective movable guide rails 48 can reliably be brought into registry with the corresponding holding portions 34 of the clamping mechanism 28.

When the piston rod 68 is fully extended, as shown in FIG. 6D, the leading top end stops 22 are transferred by the delivery fingers 66 from the movable guide rails 48 to the holding portions 34.

Upon completion of delivery of the top end stops 22, the cylinder 69 is actuated to retract its piston rod 68, as shown in FIG. 6E. Retracting movement of the piston rod 68 tends to cause the delivery arm 65 to pivot clockwise. However, this pivotal movement cannot take place because the arm holder 64 is urged by the force of the second compression coil springs 63 to slide rearwardly along the guide rods 60. When the arm holder 64 is separated from the second springs 63, the delivery arm 65 is turned clockwise in FIG. 6E until the stopper bolt 70 abuts against the arm holder 64, thus bringing the delivery fingers 66 out of engagement with the upper longitudinal edges of the movable guide rails 48. At the same time, the slide block 57 is urged rearwardly by the force of the first springs 62 to return the movable guide rails 48 to their receiving positions. During that time, the next following two top end stops 22 are released from the gate means 51 (FIG. 5) toward the downstream end portions of the fixed guide rails 45.

As the piston rod 68 is further retracted, the delivery fingers 66 pass over the leading top end stops 22, and when the piston rod 68 is fully retracted, the delivery fingers 66 are located slightly upstream of these top end stops, as shown in FIG. 6F. Then the piston rod 68 is slightly extended to pivot the arm 65 from the solid-lined position to the phantom-lined position in which the delivery fingers 66 are held in light contact with the upper longitudinal edges of the fixed guide rails 45.

Figure 8:
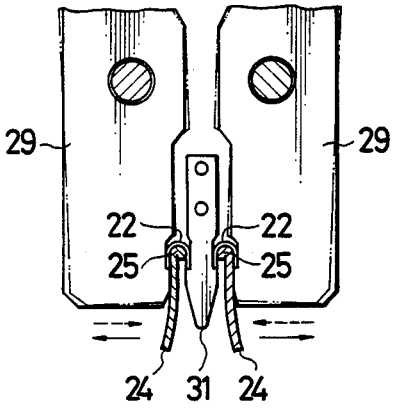
FIG. 8 is an enlarged fragmentary front elevational view showing the manner in which top end stops are attached to longitudinal marginal edges of a pair of slide fastener stringer tapes by the attaching machine.
Figure 9:
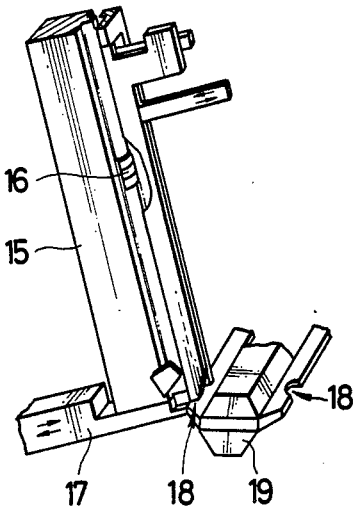
FIG. 9 (PRIOR ART)
FIG. 9 is a schematic perspective view of a conventional top end-stop supplying apparatus.

The above cycle is automatically repeated in synchronism with the operation of the clamping mechanism 28 for successively supplying pairs of top end stops to the holding portions 34 of the clamping mechanism 28, thereby enabling the clamping mechanism 28 to attach the top end stops to the continuous slide fastener chain 23 in the element-free spaces 27 at longitudinal intervals. Before the delivery of the top end stops 22, the punch arms 29, 29 are actuated to slightly spread their lower end portions, as indicated by phantom lines in FIG. 7, for easy reception of the top end stops 22. After the delivery of the top end stops 22, the punch arms 29, 29 are actuated to move their lower ends toward each other to firmly retain the delivered top end stops 22 in the holding portions 34. Immediately before the arrival of the movable guide rails 48 at the receiving positions, the actuating bolt 73 (FIG. 4) actuates the microswitch 72 to thereby lower the clamping mechanism 28 (FIG. 1) to its lowermost position to place the top end stops 22 over the beaded marginal edges 25 of the stringer tapes 24, as shown in FIG. 8. Then the ram 41 (FIG. 1) descends to move the lower end portion of the punch arms 29, 29 toward each other, thereby attaching the top end stops 22 to the stringer tapes 24.

Figure 10:
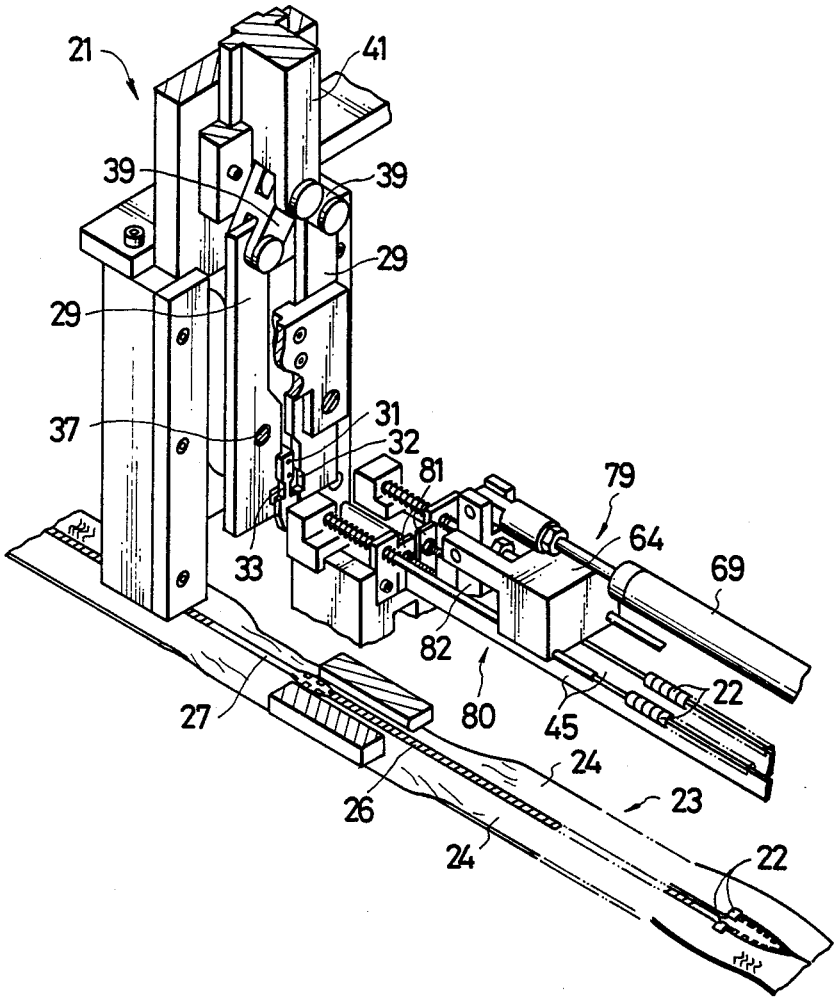
FIG. 10 is a view similar to FIG. 1, showing a modified top end-stop supplying apparatus.
Figure 11:
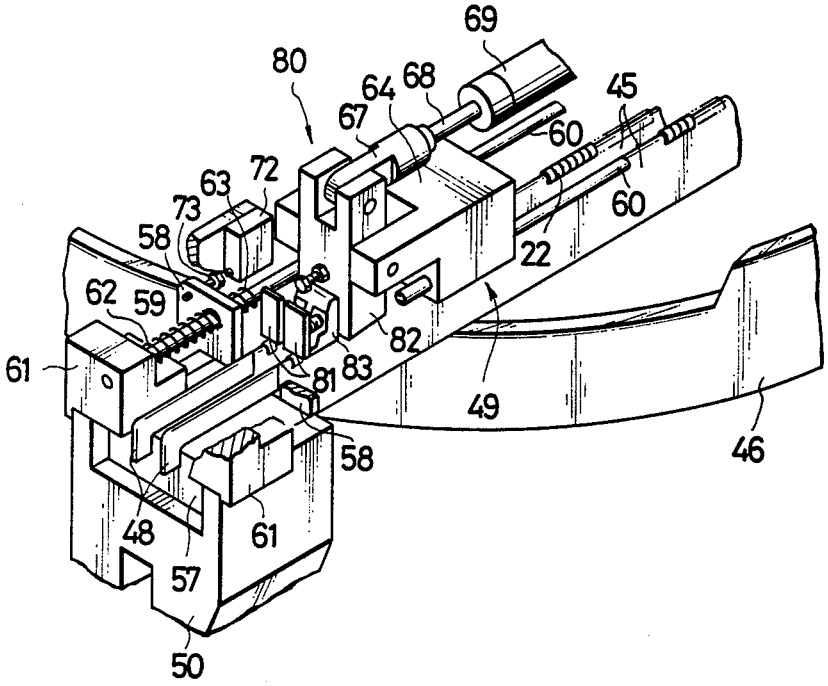
FIG. 11 is an enlarged fragmentary perspective view of the modified apparatus.

FIG. 10 shows a modified top end-stop supplying apparatus 79 associated with the top end-stop attaching machine 21. The apparatus 79 is substantially the same as the apparatus 20 shown in FIG. 1 with the exception that a delivery unit 80 includes a pair of stabilizing members 81 mounted on a delivery arm 82 for preventing upward displacement of the top end stops while they are supplied to the holding portion 34 of the clamping mechanism 28 of the machine 21. Because of the close similarity existing between these apparatus 20, 79, the like or corresponding parts are indicated by the like corresponding reference numerals throughout the drawings.

Figure 12A:
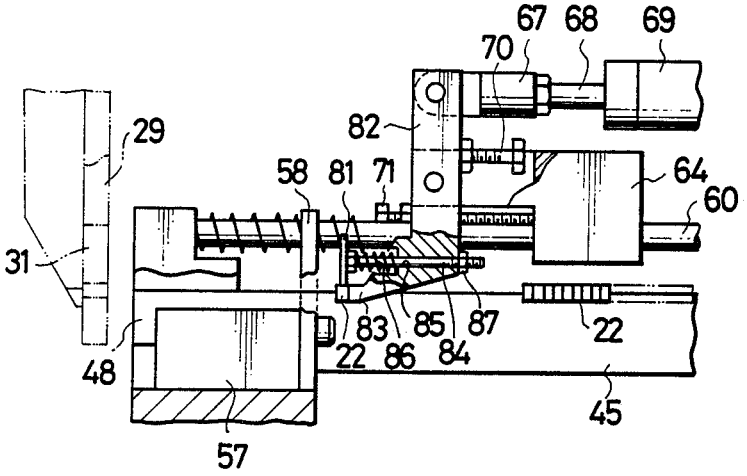
FIGS. 12A through 12D are schematic side elevational, partially cross-sectional views illustrating successive steps of the top end-stop applying operation of the modified apparatus.

As shown in FIG. 12A, the stabilizing members 81 are composed of a pair of rectangular plates mounted on the delivery arm 82 immediately downstream of a pair of delivery fingers 83, 83, and the plates 81 extending in a plane perpendicular to the plane of each guide rail 45. Each of the stabilizing members or plates 81 is connected to one end of a support rod 84 extending through a guide channel 85 in the delivery arm 82. A compression coil spring 86 is disposed around the support rod 84 and acts between the delivery arm 82 and the stabilizing plate 81 to urge the latter toward the punch arms 29. The support rod 84 is retained on the delivery arm 82 by a nut 87 threaded onto an externally threaded opposite end portion of the support rod 84. With this construction, by turning the nut 87 in either direction, the stabilizing plate 81 is adjustably movable parallel to the guide rail 45 toward and away from the arm 82 so as to accurately locate a lower edge of the stabilizing plate 81 on the leading top end stop 22.

Figure 12B:
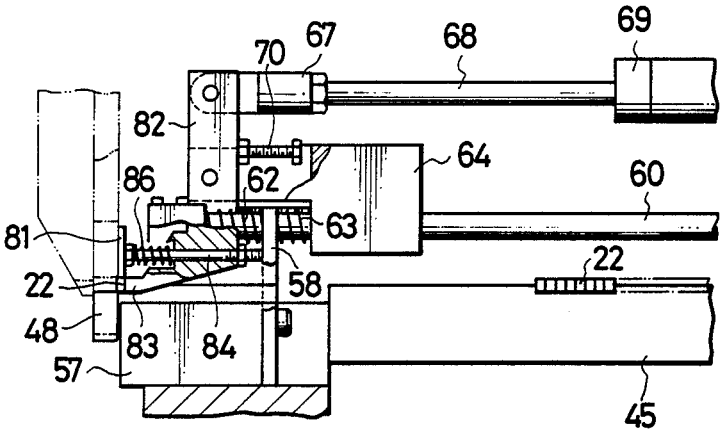
Figure 13:
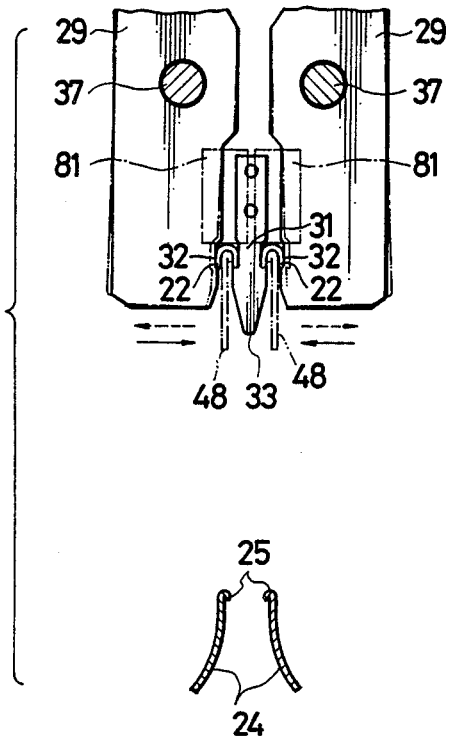
FIG. 13 is an enlarged fragmentary front elevational view of a holding portion of the attaching machine to which top stops have been supplied by the modified apparatus.

In operation, the pneumatic cylinder 69 of the apparatus 79 is actuated to extend its piston rod 68 to move the delivery arm 82 forwardly from the position of FIG. 12A to the position of FIG. 12B, thereby feeding a pair of leading top end stops 22 from the fixed guide rails 45 to the downstream ends of the respective movable guide rails 48. During that time, the stabilizing plates 81 continuously engage the top end stops 22 to prevent the latter from being displaced upwardly from the guide rails 45, 48. In the position of FIG. 12B, the stabilizing plates 81 are urged flatwise against the punch arms 29, as shown in FIG. 13.

Figure 12C:
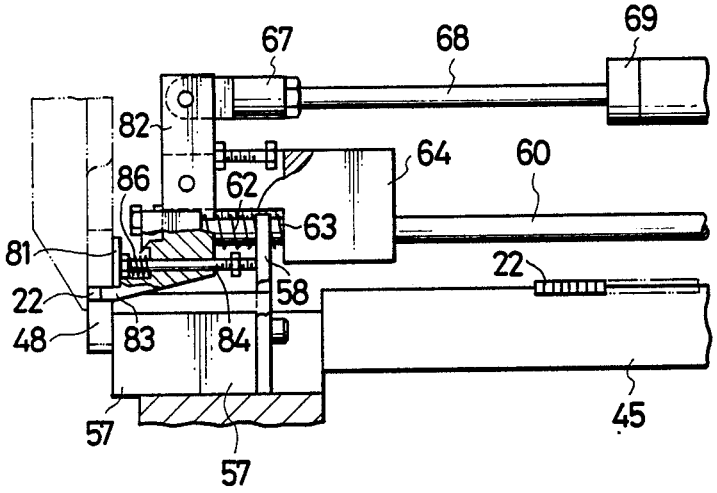
Figure 12D:
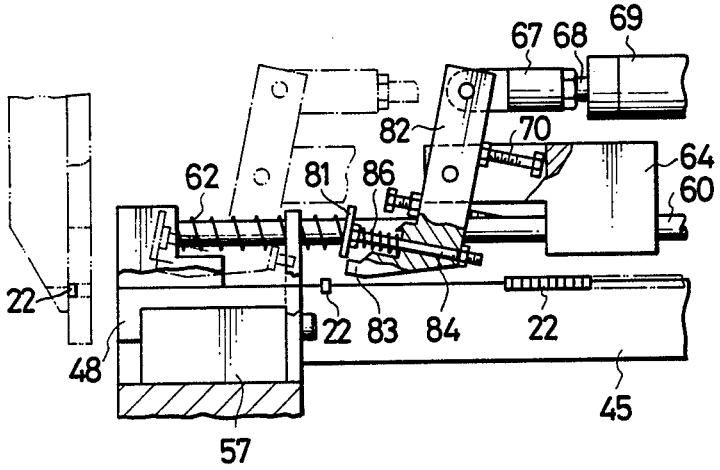

When the piston rod 68 is fully extended as shown in FIG. 12C, the delivery fingers 83 force the top end stops 22 into the holding portions 32, 33 (FIG. 13) against the bias of the compression coil spring 86. Then the piston rod 68 is retracted to return the delivery arm 82 to its original position, as shown in FIG. 12D.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A top end-stop attaching machine including an apparatus for supplying top end stops of a substantially U-shape one at a time to a holding portion of the attaching machine, said apparatus comprising:

(a) a vibrating parts feeder;

(b) a first elongate guide rail cantilevered to said parts feeder and extending therefrom toward the holding portion, said first guide rail having an upper longitudinal edge along which the top end stops are fed successively from said parts feeder toward a free end of said cantilevered first guide rail by the vibration of said parts feeder and said first guide rail;

(c) a reciprocable second elongate guide rail disposed between the holding portion and said first guide rail and having an upper longitudinal edge normally extending flush with said upper longitudinal edge of said first guide rail, said second guide rail being reciprocably movable between a receiving position in which one end of said second guide rail is held in contact with said free end of said first guide rail, and a delivery position in which the other end of said second guide rail is held in registry with the holding portion, said second guide rail being normally held in said receiving position; and (d) a delivery unit disposed above said first guide rail and reciprocably movable toward and away from the holding portion to deliver a leading top end stop from said first guide rail by way of said second guide rail to the holding portion, said delivery unit being engageable with said second guide rail within a limited range of its reciprocating stroke for moving said second guide rail from said receiving position to said delivery position.

2. An apparatus according to claim 1, further including a gate means associated with said first guide rail for allowing the passage therethrough of the top end stops one at a time.

3. An apparatus according to claim 1, further including an upstanding support block disposed near the holding portion and having a recessed upper portion, a slide block slidably received in said recessed upper portion of said support block and movable parallel to said first guide rail, said second guide rail being disposed on said slide block, at least one vertical support plate secured to an end wall of said slide block facing away from the holding portion, a bracket secured to an end of said support block remote from said end wall of said slide block in confronting relation to said vertical support plate, an elongate guide rod extending from said bracket through said support plate toward said parts feeder in parallel relation to said first and second guide rails, and a first compression coil spring disposed around said guide rod and acting between said bracket and said support plate.

4. An apparatus according to claim 3, said bracket partially overlying said slide block.

5. An apparatus according to claim 3, further including a second compression coil spring freely disposed around said guide rod in opposite relation to said first compression coil spring with respect to said support plate, said delivery unit including an arm holder slidably mounted on said guide rod, a generally L-shaped delivery arm pivotably connected to said arm holder and engageable with said second compression coil spring, said delivery arm having a delivery finger slidably engageable with said upper longitudinal edges of said first and second guide rails, and an actuator operatively connected with said delivery arm to reciprocate said delivery arm and said arm holder.

6. An apparatus according to claim 5, said delivery finger being normally located slightly upstream of said free end of said first guide rail, said second compression coil spring having a length short enough to ensure that said delivery arm is brought into compressing engagement with said second spring only when said delivery finger has moved from said first guide rail to said second guide rail.

7. An apparatus according to claim 5, said delivery arm being angularly movable to move said delivery finger between a working position in which said delivery finger is held in light contact with said upper longitudinal edge of said first guide rail, and a non-working position in which said delivery finger is upwardly spaced from said upper longitudinal edge of said first guide rail by a distance large enough to allow the passage therethrough of the top end stops.

8. An apparatus according to claim 7, including means for preventing said delivery arm from angularly moving beyond said working and non-working positions.

9. An apparatus according to claim 8, said preventing means comprising a pair of stopper bolts disposed on opposite sides of the pivotal connection between said delivery arm and said arm holder and engageable with said arm holder.

10. An apparatus according to claim 5, said delivery finger having a recessed bottom wall receptive of said upper longitudinal edges of said first and second guide rails.

11. An apparatus according to claim 5, said actuator comprising a pneumatic cylinder extending parallel to said first guide rail.

12. An apparatus according to claim 1, said delivery unit including stabilizing means continuously engageable with the leading top end stop as it is moved along said upper longitudinal edges of said first and second guide rails, for preventing the leading top end stop from moving upwardly away from said upper longitudinal edges of said first and second guide rails.

13. An apparatus according to claim 12, said delivery unit including a delivery arm reciprocably movable along said first and second guide rails and having a delivery finger slidably engageable with said upper longitudinal edges of said first and second guide rails, said stabilizing means comprising a rectangular plate vertically disposed adjacent to said delivery finger.

14. An apparatus according to claim 13, further including a support rod extending perpendicularly from said vertical plate and slidably supported by said delivery arm, and a compression coil spring disposed between said support rod and acting between said vertical plate and said delivery arm.

* * * * *